US005829789A

United States Patent [19]

Treleaven et al.

[11] Patent Number: 5,829,789

[45] Date of Patent: Nov. 3, 1998

[54] PRIMARY LABEL WITH REMOVABLE SELF-ADHESIVE LABELS

[75] Inventors: Carl W. Treleaven, Greensboro, N.C.; Glenn Grosskopf, Lake Zurich, Ill.; Robert Gerstung, Carol Stream, Ill.; James Hennessy, Chicago, Ill.; Robert Pavetto, Palatine, Ill.

[73] Assignees: Pharmagraphics (Midwest), L.L.C.; Pharmagraphics (Southeast), L.L.C., both of Greensboro, N.C.

[21] Appl. No.: 943,458

[22] Filed: Oct. 3, 1997

Related U.S. Application Data

[63] Continuation of Ser. No. 533,082, Sep. 25, 1995, abandoned.

[51] Int. Cl.[6] ..... B42D 15/00; B32B 3/10

[52] U.S. Cl. ..... 283/81; 283/101; 40/306; 428/41.8; 428/41.9; 428/42.3

[58] Field of Search ..... 283/81, 900, 99, 283/101; 40/306, 310; 428/41.8, 41.9, 42.3

[56] References Cited

U.S. PATENT DOCUMENTS

| | | | |
|---|---|---|---|
| 3,484,976 | 12/1969 | Shea | 283/81 |
| 3,593,443 | 7/1971 | Demetrius, Jr. | 40/2 R |
| 3,702,511 | 11/1972 | Miller | 40/306 |
| 3,822,492 | 7/1974 | Crawley | 40/2 |
| 4,010,299 | 3/1977 | Hershey, Jr. et al. | 428/44 |
| 4,479,838 | 10/1984 | Dunsirn et al. | 156/247 |
| 4,910,058 | 3/1990 | Jameson | 283/101 |
| 4,964,512 | 10/1990 | Ingram et al. | 206/459 |
| 4,964,513 | 10/1990 | Ingram et al. | 206/459 |
| 4,995,642 | 2/1991 | Juszak et al. | 283/105 |
| 5,007,663 | 4/1991 | Moran | 283/81 |
| 5,074,595 | 12/1991 | Hill et al. | 283/81 |
| 5,172,936 | 12/1992 | Sullivan et al. | 283/81 |
| 5,182,152 | 1/1993 | Ericson | 428/42 |
| 5,227,209 | 7/1993 | Garland | 428/40 |
| 5,238,720 | 8/1993 | Volkman | 428/40 |
| 5,271,642 | 12/1993 | Jahier et al. | 283/81 |
| 5,284,363 | 2/1994 | Gartner et al. | 283/81 |
| 5,290,616 | 3/1994 | Cowan et al. | 428/40 |
| 5,329,713 | 7/1994 | Lundell | 40/310 |
| 5,342,093 | 8/1994 | Weernink | 283/81 |
| 5,350,612 | 9/1994 | Stern et al. | 428/40 |
| 5,352,155 | 10/1994 | Fahey | 283/900 |
| 5,403,636 | 4/1995 | Crum | 428/40 |
| 5,547,227 | 8/1996 | Laurash et al. | 283/81 |
| 5,702,127 | 12/1997 | Korondi, Jr. | 283/81 |
| 5,704,648 | 1/1998 | Brown et al. | 283/81 |

FOREIGN PATENT DOCUMENTS

| | | | |
|---|---|---|---|
| 0349670A1 | 1/1990 | European Pat. Off. . | |
| 2402264 | 4/1979 | France | 283/81 |

*Primary Examiner*—David P. Bryant
*Attorney, Agent, or Firm*—Myers Bigel Sibley & Sajovec, P.C.

[57] ABSTRACT

A label product for attaching to a package and having, as a part thereof, at least one removable portion which the user may detach from the package and reapply to a second package.

30 Claims, 11 Drawing Sheets

PRIMARY LABEL WITH REMOVABLE SELF-ADHESIVE LABELS

This application is a continuation of application Ser. No. 08/533,082, filed Sep. 25, 1995, now abandoned.

FIELD OF THE INVENTION

The present invention is directed to labels, and, more particularly, to a primary label having integrally formed, and removable secondary labels attached thereto.

BACKGROUND OF THE INVENTION

Labels, for example self-adhesive labels, are commonly used to display various indicia or information regarding a chosen object. The labels may be applied to a package or container to identify the contents thereof and/or relate information concerning the contents. It has become increasingly desirable to provide such labels which include, as a part thereof, at least one removable portion which the user may detach from the package.

It is known, for example, to provide labels having removable coupon portions so that the consumer may remove and redeem the coupon at the point of sale. The remainder of the label may remain with the package and may include indicia relating thereto. Because these removable portions are intended to function as conventional coupons once removed, they are typically non-adhesive once removed. Examples of the aforedescribed labels are shown in U.S. Pat. No. 5,172,936 to Sullivan et al. and U.S. Pat. No. 5,329,713 to Lundell.

It is also known to provide pressure sensitive labels consisting of an adhesive backed release liner having a self-adhesive backed layer of face stock or the like releasably adhered to the release side of the liner. Such labels may be referred to as "piggy back" labels. After the label has been adhered to a package by means of the adhesive of the release liner, the end user may remove the layer of face stock and reapply it to another substrate using the adhesive on the back of the face stock. These labels are only provided with indicia on the upper surface of the face stock so that, when the upper ply is removed from the label, no indicia disposed on the remaining portion of the label is left to identify or characterize the package. A variation of the above described "piggy back" label is shown in U.S. Pat. No. 3,822,492 to Crawley wherein the disclosed label is adhered to the package by adhesive disposed on portions of the face stock with a non-adhesive backed release liner interposed between the remainder of the face stock and the package.

While the above described label products may be suitable for their intended uses, they are wholly inadequate for other applications. For example, in pharmaceutical and similar applications a bulk container is provided to a distributor such as a pharmacist or physician to be subdivided and repackaged. Two concerns arise in such case. First, the bulk container must provided with identifying and descriptive information. The information may include, for example, warnings, advertising, dosage instructions, disclaimers, and lot and expiration data. To ensure that the contents are positively identified and the integrity of the warnings, etc., are brought to the attention of the distributor, this information should be permanently secured to the bulk container. Secondly, provision should be made for conveniently and accurately identifying and describing the contents of the subdivision packages (e.g., containers in which prescribed quantities are distributed to patients). To ensure that the contents are positively identified and the integrity of the warnings, etc., are brought to the attention of the end users, this information should be permanently secured to the second containers.

The label designs of the prior art do not meet the needs of the bulk packaging/repackaging set forth above. In the case of the labels of the first design discussed (i.e., having removable coupons) no provision is made for securing the removable portion to a second substrate, for example, the second container. In the case of the "piggy back" labels, no provision is made for permanently securing indicia to the bulk container.

Accordingly, there exists a need for a label product which provides a primary portion which may be permanently secured to a first object and one or more second portions which are initially carried by the label product on the first object, but may be conveniently removed and permanently secured to a second object. In addition to the above described application, a label product making such provisions would also have many other advantageous uses such as, for example, a product label having removable novelty stickers.

There is a need for such a label product which may be, when positioned on the first object, opened to remove one or more of the second portions and resealed to protect one or more further second portions remaining on the label product.

There is a need for a label product as described above which allows for convenient and effective selection of release materials, stock materials, and adhesives as needed for the intended first and second objects.

There exists a need for a method for forming label products as described above which is efficient and cost effective.

SUMMARY OF THE INVENTION

The present invention is directed to a label product for attaching to a package and having, as a part thereof, at least one removable portion which the user may detach from the package and reapply to a second package. Generally, the label product is made up of first and second types of labels formed integrally together. The first type includes primary information to be used on a first type of package and the second type includes secondary information to be used on a second type of package. The label product includes a permanent portion having an upper surface and a lower surface. The lower surface is coated with a first adhesive which is operative to substantially permanently secure the permanent portion to the first package. The label product further includes a primary label integrally formed with and as a part of the permanent portion. The primary label has an upper surface and a lower surface. The upper surface has primary indicia thereon representing the primary information concerning the first type of package. The label product also includes at least one temporary portion removably secured to the permanent portion such that the temporary portion may be selectively removed from the first package. A secondary label forms a part of the temporary portion. The secondary label has an upper surface and a lower surface. The upper surface has secondary indicia thereon representing the secondary information concerning the second type of package. The secondary label is adhesively and releasably adhered to the remainder of the label product by a varnish coating and a second adhesive such that the secondary label may be selectively removed from the remainder of the label product and applied to one of the second types of packages.

Preferably, the label product includes a plurality of the secondary labels.

The label product as described above may be constructed in several forms, as set forth below.

The label product may include a base layer having a lower surface and an upper surface, the first adhesive being disposed on the lower surface of the base layer. A top layer overlies the base layer and has a lower surface and an upper surface. The primary label and the secondary label each form a part of the top layer. The second adhesive is disposed on the lower surface of the top layer. The varnish coating covers a portion of the upper surface of the base layer and a portion of the upper surface of the base layer is not covered by the varnish coating. The covered portion is disposed beneath the secondary label and the uncovered portion is disposed beneath the primary label.

The label product may be constructed such that the permanent portion includes a first panel having an upper surface and a lower surface. The primary indicia is disposed on the upper surface of the first panel and the first adhesive is disposed on the lower surface of the first panel. The temporary portion includes a second panel joined to an edge of the first panel by a fold. The secondary label is releasably adhered to the second panel by the second adhesive. The secondary label may be adhered to an interior surface of the second panel, the varnish coating being disposed on the interior surface adjacent the second adhesive. The label product may further include a laminate cover adhered to an exterior surface of the second panel and a marginal portion extending beyond an edge of the second panel. Moreover, the first panel may include an edge flap extending beyond an adjacent edge of the second panel, the marginal portion being releasably and resealably adhered to the edge flap by a laminate adhesive. The second panel may be detachably joined to the first panel.

The label product as first described may include a base layer having a lower surface and an upper surface. The first adhesive is disposed on the lower surface and the varnish coating is disposed on the upper surface. A top layer overlies a portion of the upper surface of the base layer. The top layer has a lower surface and an upper surface. The secondary label forms a part of the top layer. The secondary indicia is disposed on the upper surface of the top layer and the second adhesive is disposed on the lower surface of the top layer. The entirety of the portion of the upper surface of the base layer is covered by the varnish coating, whereby the entirety of the top layer is releasably adhered to the portion by the second adhesive and the varnish coating. Preferably, the entirety of the upper surface of the base layer is covered by the varnish coating.

The label product as described in the immediately preceding paragraph may be constructed in various forms, as discussed hereinbelow.

The label product may include a tertiary label forming a part of the top layer and overlying a second portion of the upper surface of the base layer. The tertiary label has an upper surface, a lower surface, and tertiary indicia disposed on its upper surface. The second adhesive is disposed on the lower surface of the tertiary label. The primary indicia is disposed on the upper surface of the base layer and the tertiary label overlies the primary indicia. The tertiary indicia may be substantially identical to the primary indicia. Preferably, the entirety of the upper surface of the base layer is covered by the varnish coating.

Alternatively, the label product may be constructed such that the upper surface of the base layer includes an exposed portion which is not covered by the top layer. The primary indicia is disposed on the exposed portion. Preferably, the entirety of the upper surface of the base layer is covered by the varnish coating.

Alternatively, the label product may be formed such that the primary label forms a part of the top layer. The primary label extends beyond and does not overlie the base layer. Preferably, the entirety of the upper surface of the base layer is covered by the varnish coating.

Alternatively, the label product may be constructed such that the base layer includes first and second panels joined to one another at a fold. Each of the panels has an upper surface and a lower surface. The first adhesive is disposed on the lower surface of the first panel but not on the lower surface of the second panel. The primary indicia is disposed on the upper surface of the first panel. The top layer overlies the upper surface of the second panel. The first and second panels may be detachably joined at the fold by a tear line. Preferably, the entireties of the upper surfaces of the first and second panels are covered with the varnish coating. The top layer may be substantially transparent.

An object of the present invention is to provide a label product including primary and secondary labels, the primary label adapted to substantially permanently secure the label product to a first object, and the secondary label adapted to be removed from the first object and substantially permanently secured to a second object.

A further object of the present invention is to provide such a label product wherein the primary label includes selected primary indicia and the secondary label includes selected secondary indicia.

Moreover, an object of the present invention is to provide such a label product comprising a plurality of such secondary labels.

An object of the present invention is to provide a label product as described above having multiple panels each of which include secondary labels releasably secured thereto.

A primary object of the present invention is to provide such a label product which allows for discretionary selection of adhesives, release materials, and stock materials so that a given label product may be customized to the intended application.

A further object of the present invention is to provide a method for forming label products as set forth above.

Yet another object of the present invention is to provide such a method which is convenient and cost effective.

The preceding and further objects of the present invention will be appreciated by those of ordinary skill in the art from a reading of the Figures and the detailed description of the preferred embodiment which follow, such description being merely illustrative of the present invention.

DETAILED DESCRIPTION OF THE PREFERRED EMBODIMENT

Figure 1:
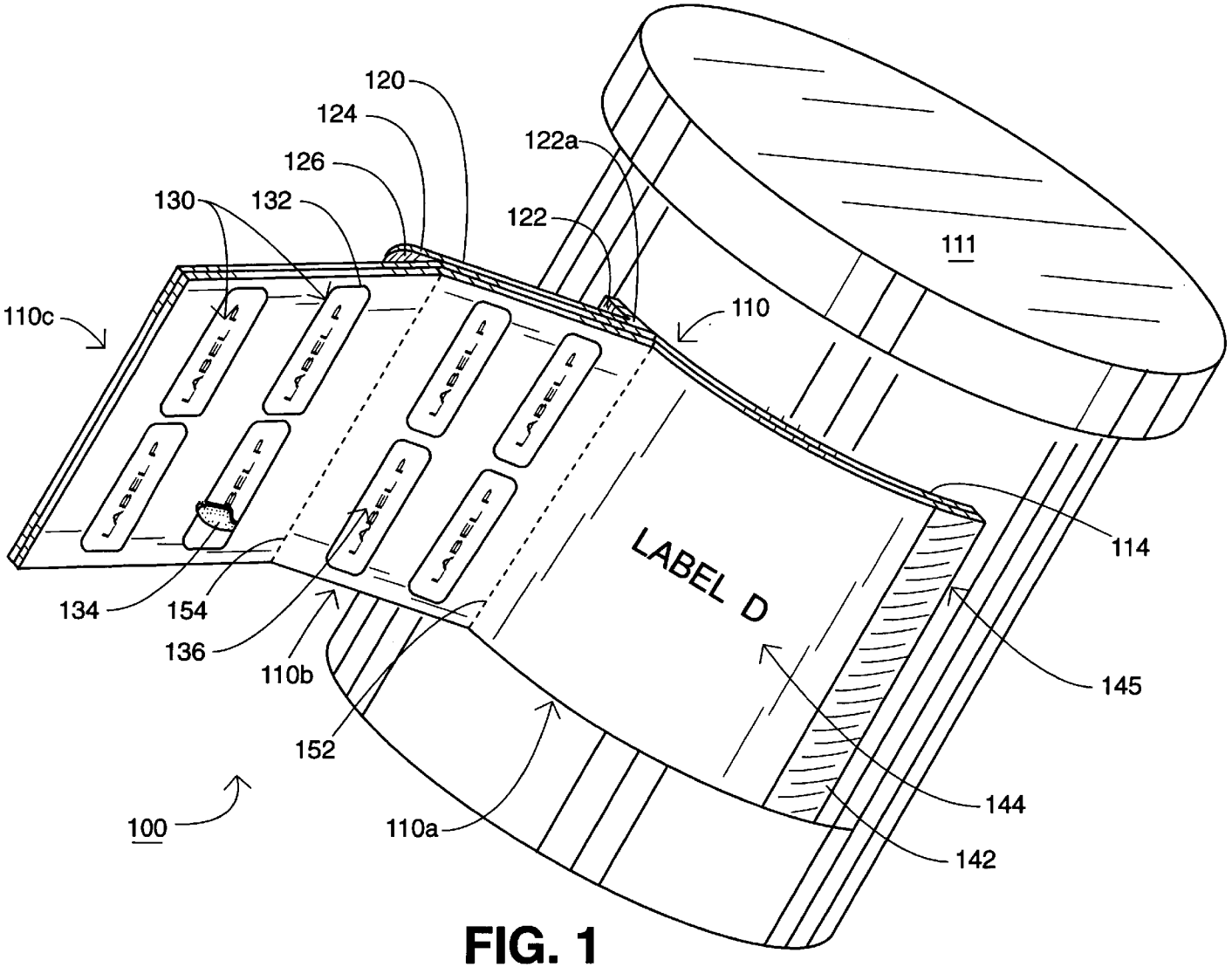
FIG. 1 is a perspective view of a label incorporating a leaflet according to the present invention and mounted on a container, wherein the label is shown in an open configuration with one of the secondary labels partially removed.
Figure 2:
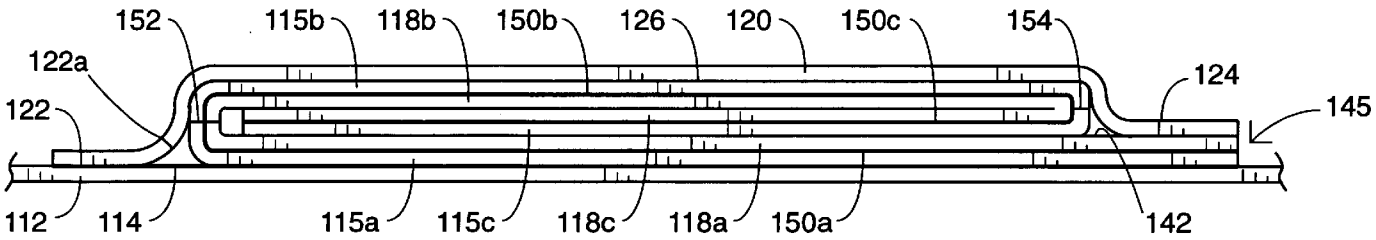
FIG. 2 is a side elevational view of the label of FIG. 1 shown in a closed configuration and mounted on the release liner.

With reference to FIGS. 1 and 2, a label according to a first embodiment of the present invention, generally denoted by the numeral 100, is shown therein. Label 100 comprises multi-layer, multipanel leaflet 110 covered by laminate cover 120 and disposed on adhesive patch 114 which is in turn disposed on release liner 112 or, for example, on container 111.

Figure 3:
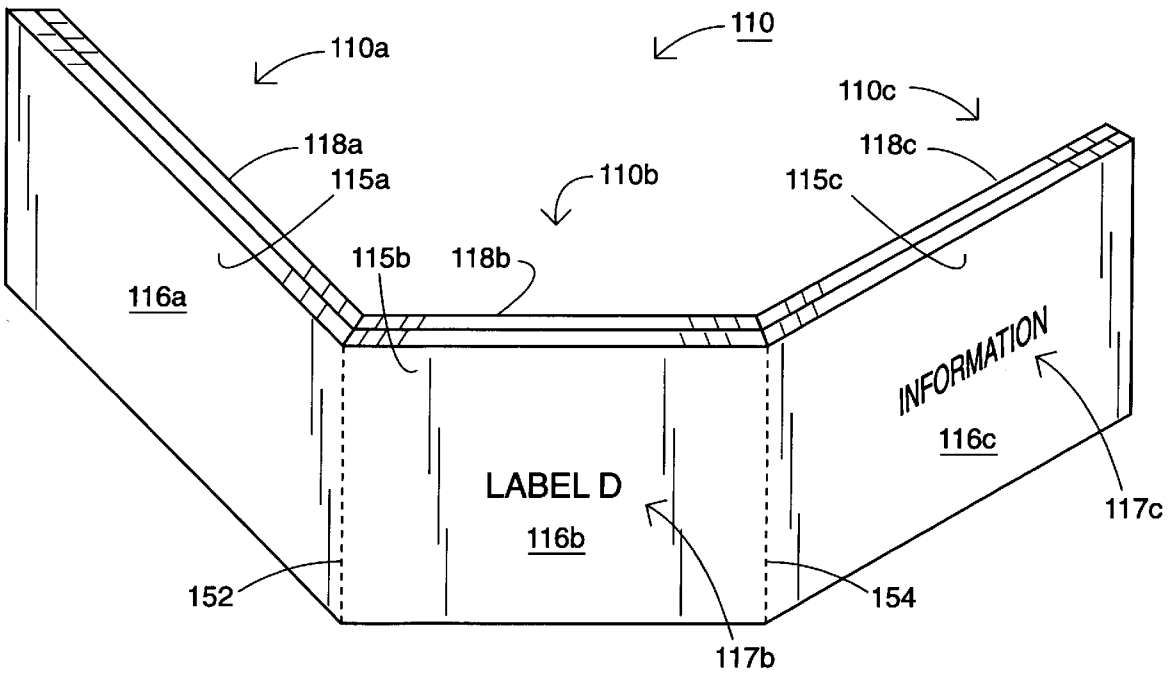
FIG. 3 is a perspective view of the leaflet according to the present invention.

Leaflet 110 is also shown, without the remaining portions of label 100, in FIG. 3. Leaflet 110 includes leaflet panels 110*a*, 110*b*, 110*c*. Panels 110*a*, 110*b*, 110*c* are relatively detachable by means of tear lines 152,154.

Panel 110*a* is removably secured to and carried by a release liner 112 (FIG. 2) by pressure sensitive adhesive 114, and serves as a primary label which may be permanently secured by means of the adhesive to a container 111 (FIG. 1), such as a pharmacist's supply container.

Panels 110*b*,110*c* each include a plurality of secondary labels 130. Each of secondary labels 130 are defined by cut lines 132 and are releasably secured to their respective panel 110*b*,110*c* by means of pressure sensitive adhesive 134. Each secondary label 130 may be removed from leaflet 110 and secured by means of adhesive 134 to a container, for example, such as a patient's individual container.

Laminate cover 120 is secured to outer surface 116*b* of leaflet 110 by adhesive 126 and is removably secured to release liner 112 (FIG. 2) by marginal portion 122 and adhesive 114. Laminate cover 120 includes tear line 122*a* so that, when marginal portion 122 is secured to container 111 by means of adhesive 114 (FIG. 1) and the user wishes to remove laminate cover 120 (along with panels 110*b*,110*c*), he or she may do so by tearing along tear line 122*a*. Label 100 is openable and resealable by means of the adhesive 126 at marginal portion 124 which interfaces with varnish strip 142 disposed on the upper surface of edge flap 145 of primary label 110*a*.

Turning to leaflet 110 in greater detail, each of panels 110*a*, 110*b*, and 110*c* consist of a first layer and a second layer. Primary label or panel 110*a* includes first layer 115*a* and second layer 118*a*; panel 110*b* includes first layer 115*b* and second layer 118*b*; panel 110*c* includes first layer 115*c* and second layer 118*c*. The first and second layers of each of panels 110*a*, 110*b*, and 110*c* are adhered together by means of pressure sensitive adhesive layers 150*a*, 150*b*, and 150*c*, respectively. The surface of first layer 115*b* adjacent second layer 118*b* and the surface of first layer 115*c* adjacent second layer 118*c* are each coated with silicon varnish. Second layers 118*b* and 118*c* (and, thus, secondary labels 130) are thereby releasably secured to first layers 115*b* and 115*c*, respectively, by means of associated pressure sensitive adhesive layers 150*b* and 150*c*. Because the surface of first layer 115*a* adjacent second layer 118*a* is not provided with varnish, layers 115*a* and 118*a* are permanently bonded together. Adhesive patch 114 is permanently adhered to outer surface 116*a* of panel 110*a*. Cut lines 132 extend through layers 118*b*,118*c* down to layers 115*b*,115*c*.

Primary label or panel 110*a* may be provided with indicia 144. Secondary labels 130 are preferably provided with related indicia 136. Further indicia 117*b*, 117*c* may be provided on outer surfaces 116*b* and 116*c* of first layers 115*b* and 115*c*, respectively. Indicia could also be placed on outer surface 116*a* of panel 110*a*.

Leaflet 110 or label 100 incorporating leaflet 110 may be used in a number of varied applications. For example, leaflet 110 may be placed as an insert in a package so that the consumer or end user is provided with a plurality of removable self-adhesive labels for use as coupons, novelty stickers, or the like. Label 100 may be adhered to the outside of a package for the same purpose. In particular, if label 100 is used, the end user may open label 100 by pulling marginal portion 124 of laminate 120 away from primary label 110*a* at varnish strip 142. The end user then peels away one or more secondary labels 130 and can refold and reseal laminate cover 120. Leaflet 110 and label 100 are particularly well suited for use with bulk packaging of goods which are ultimately intended to be individually packaged, as discussed in more detail with respect to label 200 according to a second embodiment of the invention, below. Moreover, when the secondary labels 130 are depleted, or it is otherwise no longer desired to have panels 110*b* and 110*c* on the package, the user may remove panel 110*c* by means of tear line 154, or remove both panels 110*b* and 110*c* by means of tear lines 152 and 122*a*.

Leaflets 110 as described above may be formed as follows. A six color Mark Andy 2200 flexographic printing press available from Mark Andy, Inc. of Chesterfield, Mo. may be used to print leaflets 110, however, any suitable apparatus may be used. Other suitable apparatus include letter presses and offset presses.

Figure 4:
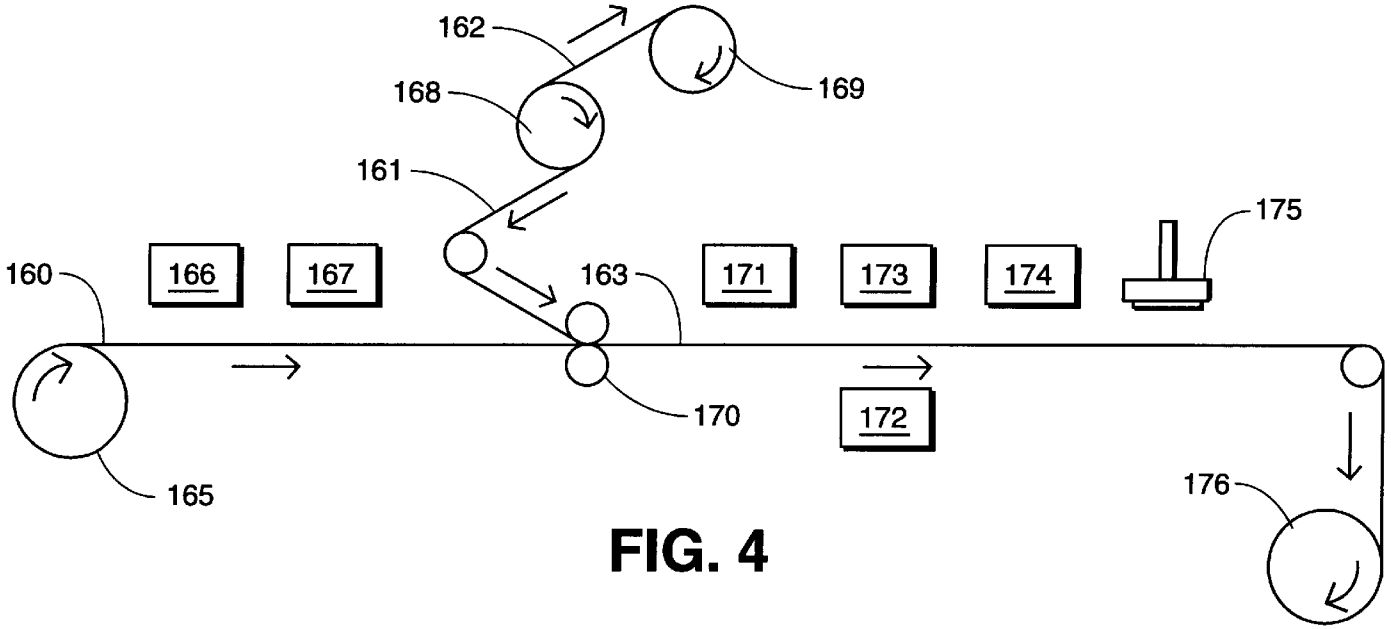
FIG. 4 is a schematic diagram showing an apparatus for forming leaflets according to the present invention.

With reference to FIG. 4, base web 160 is supplied from unwind stand 165. Simultaneous with the supply of base web 160, self-adhesive stock web 161 is supplied from unwind stand 168. Base web 160 ultimately forms first layers 115*a*, 115*b*, 115*c* of the resulting leaflets 110. Self-adhesive stock web 161, with release liner 162 removed, ultimately forms second layers 118*a*, 118*b*, 118*c* of leaflets 110.

Base web 160 is preferably a simple base stock formed from paper and having no adhesive layer or release liner. Base web 160 first passes through varnish printer station 166 at which point varnish is applied to selected portions of base web 160. More particularly, the selected portions correspond to the surfaces of first layers 115*b* and 115*c* adjacent second layers 118*b* and 118*c*. Thereafter, base web 160 passes through UV curing unit 167 in order to cure the applied varnish coating.

Self-adhesive stock web 161 may be provided as a self-adhesive face stock having a release liner, the release liner 162 simultaneously being removed to rewind stand 169. Self-adhesive stock web 161 may be, for example, high gloss paper with S246 adhesive available from Fasson of Painesville, Ohio.

Base web 160 and self-adhesive stock web 161 are married at nip rollers 170, thereby forming multi-layer composite web 163. Notably, where varnish has not been applied by varnish print station 166, the two webs are permanently adhered. Where varnish has been applied, the webs are releasably adhered.

Composite web 163 is drawn through one or more print stations 171 to apply indicia 136, 144. Composite web 163 is also passed through any number of print stations 172 to apply indicia 117*b*, 117*c*. Optionally, indicia may be printed on the upper surface of base web 160 prior to application of the varnish by a printing station (not shown).

Thereafter, composite web 163 is passed through varnish print station 173 which applies an overprint varnish to protect the aforesaid indicias. Varnish print station 173 may also be used to apply varnish strip 142. Coated composite web 163 is then passed through UV curing unit 174 to cure the varnish.

Composite web 163 is then die cut by die cut station 175 down to base web 160 to form die cuts 132 which define secondary labels 130. Optionally, the waste matrix defined outside the diecuts may be taken up on a rewind stand (not shown). This could be accomplished by providing a continuous waste matrix border alongside the portion of the web from which the leaflets are ultimately formed.

Composite web 163 may thereafter be "sheeted" into individual strips and stacked or, alternatively, rewound onto rewind stand 176 and later cut into individual strips. Alternatively, web 163 could be cut and folded on a roll folder.

The individual strips so formed may then be folded on a conventional folder, such as a Machine by Oppenheimer (MBO) available from MBO America of Illinois.

Although, in the description above, the two webs are married after varnish print station 166, the two webs could be married anywhere between the first and last print stations, permitting any number or combination of colors to be printed on each side of the web. Accordingly, one may print on the interior surfaces of first layers 115*b*,115*c* (i.e., the surfaces ultimately adjacent second layers 118*b*,118*c*) so that indicia so printed can be seen when secondary labels 130 are removed from the leaflet. Preferably, UV curing unit 167 is portable so that it may be placed along the apparatus as desired.

Labels 100 may be formed using leaflets 110 by the following method.

Figure 5:
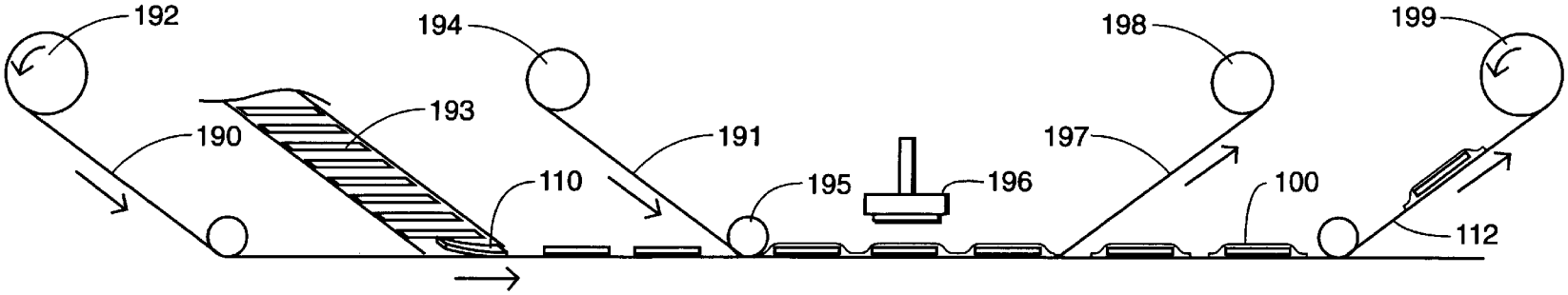
FIG. 5 is a schematic diagram showing an apparatus for forming labels according to the present invention.

With reference to FIG. 5, transfer tape web 190 consisting of a release liner and an adhesive layer, for example, 3M Product #9447, 1 millimeter high tenacity tape with 320 adhesive, is supplied from unwind stand 192. Leaflets 110 are applied from leaflet applicator 193, for example, an Onsert Machine available from Onsert Systems of Toronto, Canada. Thereafter, adhesive backed laminate web 191 is supplied from unwind stand 194 and married to leaflets 110 and transfer tape web 190 by nip roller 195. The resulting construction is then die cut in the shape of labels 100 by die cut station 196. Waste matrix 197, typically comprising unwanted portions of laminate web 191, excess adhesive from transfer tape 190, and portions of the leaflet, is removed by rewind stand 198. The resulting labels 100 mounted on release liner 112 are then wound onto rewind stand 199.

It will be appreciated that, instead of transfer tape web 190, a conventional self-adhesive base stock comprising a face stock plus adhesive and a release liner may be used. As a further alternative, a double coated tape web such as 3M Scotch Brand Tape Product #9458, may be used as well. Moreover, it will be appreciated that any conventional label construction designed to incorporate an extended text label may be practiced using leaflet 110 and may be formed by any conventional or suitable method.

It will be appreciated that the above-described method for forming leaflets 110 may be used to produce pressure sensitive label products other than labels 100 or the like. For example, leaflets 110 may be provided without an adhesive patch 114. Such leaflets may serve as inserts for carrying a plurality of pressure sensitive adhesive labels 130, as discussed below. Thus, it is contemplated that a variety of leaflet designs incorporating removable pressure sensitive labels and having printing on both sides and no release liner may be formed.

Further, it will be appreciated that leaflets 110 and labels 100 formed therefrom may include any number of panels in addition to panels 110*b*, 110*c*.

Label 100 may be modified as follows. The upper web may be provided as a clear pressure sensitive film. The adhesive release coating or varnish is printed over the entirety of the upper surface of the lower or base web, rather than only selectively as in the embodiment discussed above. That is, varnish is applied to the entireties of the surfaces of first layers 115*a*, 115*b*, and 115*c* adjacent second layers 118*a*, 118*b*, and 118*c*. Both sides of the base web are printed with as many colors as desired. Primary indicia are printed on the upper surface of first layer 115*a*. After the varnish is UV cured, the upper web is laminated onto the base web as described above. Selected portions of the upper, clear surface of the upper web are printed and the upper web is then die cut to form secondary labels. Thereafter, the waste matrix may be removed and the composite web cut and folded, and ultimately applied to a transfer tape, as discussed above. Secondary labels may be formed on panel 110*a* by cutting through the clear film and down to the varnish coated surface of the base web.

The modified version of label 100 would have the following characteristics. First, secondary labels may be provided on panel 110*a* because a varnish coating is provided between layers 115*a* and 118*a*. If the user chooses to tear away panels 110*b* and 110*c* as discussed above, any secondary labels formed on panel 110*a* will remain with the container until thereafter removed from panel 110*a*. The primary indicia printed on the upper surface of layer 115*a* is permanently secured to any container to which label 100 is applied and may be viewed through the clear film.

Figure 6:
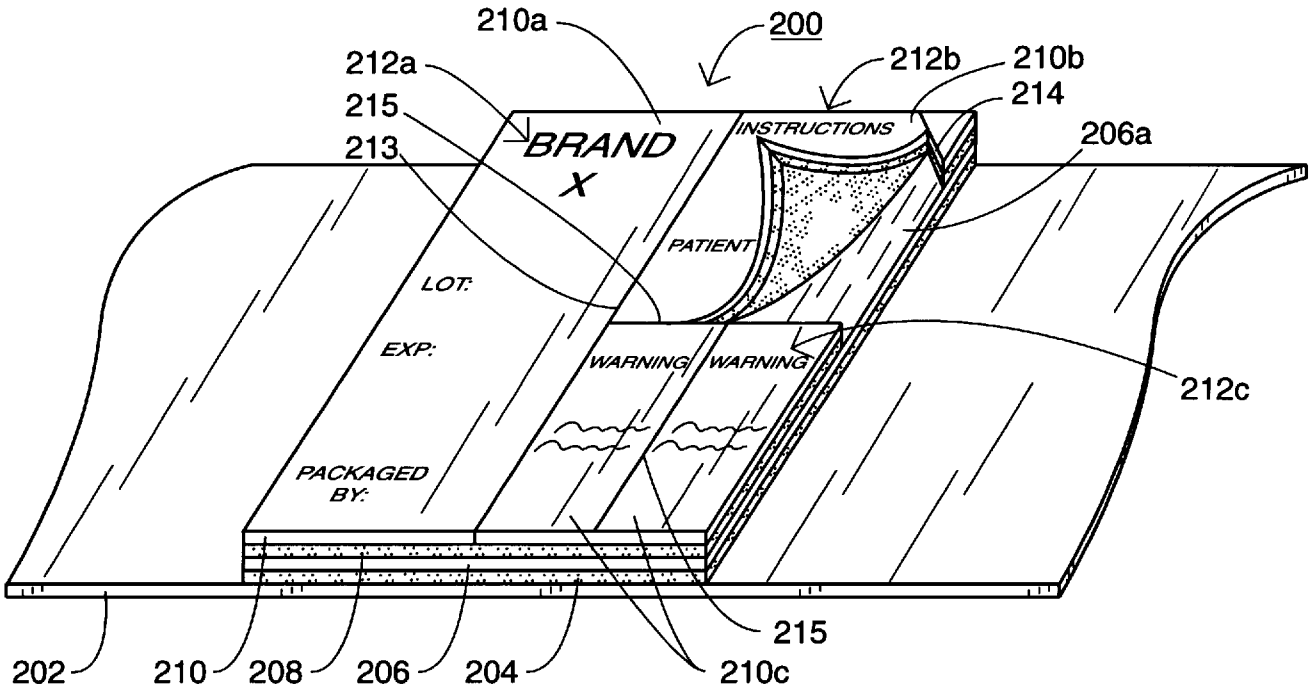
FIG. 6 is a perspective view of a label according to a second embodiment of the present invention wherein one of the secondary labels is partially removed.
Figure 7:
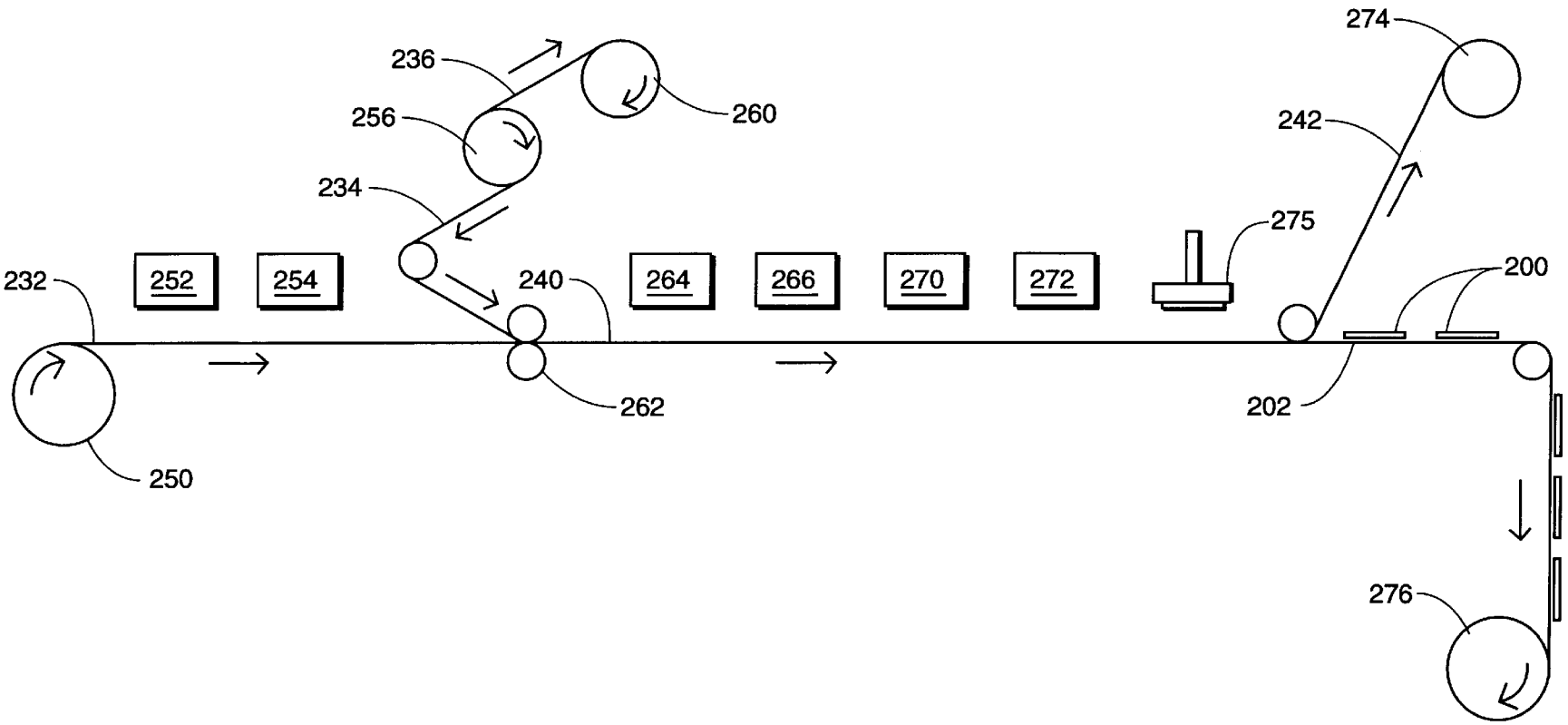
FIG. 7 is a schematic diagram showing an apparatus for forming labels according to the second embodiment.

With reference to FIGS. 6 and 7, a label according to a second embodiment of the present invention, generally denoted by the numeral 200, is shown therein. Label 200 is carried on release liner 202 and may be secured to a container or the like.

Label 200 includes base layer 206 releasably adhered to release liner 202 by pressure sensitive adhesive 204. When label 200 is removed from release liner 202, adhesive 204 separates from the release liner and remains on the underside of base layer 206, providing a pressure sensitive label. Top layer 210 is adhered to the upper surface of base layer 206 by pressure sensitive adhesive 208. Portion 210*a* (hereinafter "primary label 210*a*") is substantially permanently adhered to the upper surface of base layer 206. The portions of the upper surface of base layer 206 which are disposed under portions 210*b* and 210*c* (hereinafter "secondary labels 210*b*,210*c*") of top layer 210 are coated with a release varnish 206*a* such that secondary labels 210*b*,210*c* are releasably adhered to base layer 206. When each of secondary labels 210*b*,210*c* are removed from base layer 206, the underlying adhesive 208 separates from the varnish coated surface and remains on the underside of the secondary label, providing a pressure sensitive label. Indicia 212*a*, 212*b*, and 212*c* may be provided on each of primary label 210*a* and secondary labels 210*b*,210*c*, respectively. Primary label 210*a* and secondary labels 210*b*,210*c* are separated by cut lines 213,215 each of which extend down to the varnish coated surface. Cut line 214 may be provided to facilitate removal of secondary label 210*b*.

Preferably, the relative adherence between adhesive layer 204 and any intended surface (e.g., a container) and the adherence between adhesive 204 and the lower surface of base layer 206 are significantly less than the adherence between adhesive layer 208 and the varnish coated portions of the upper surface of base layer 206. In this way, when label 200 is secured to a container and the user pulls up on a secondary label 210*b*,210*c*, base layer 206 and, therefore, primary label 210*a* will remain secured to the container. Preferably, adhesive 208 is substantially permanently adhered to the portion of the upper surface of base layer 206 underneath primary label 210*a* and the lower surface of primary label 210*a* so that any attempt to separate the primary label from the base layer will be made difficult or impossible without mutilation of the label.

The following example merely illustrates one of many uses for label 200, as well as label 100 as described above. A pharmaceutical distributor, for example, may package relatively large quantities of goods in bulk containers. The pharmaceutical distributor would remove label 200 from release liner 202 and adhere it to the bulk container by means of adhesive layer 204. Indicia 212*a* of primary label 210*a* may include, for example, as shown, a brand name for the goods, lot and expiration information regarding the goods, instructions to a secondary distributor, and quality control information such as the packager of the goods. The secondary distributor, such as a physician or pharmacist, would receive the bulk packaged goods with label 200 adhered thereto. For each subpackage (e.g., packages containing a smaller quantity of goods for individual patients), the pharmacist would remove one of secondary labels 210*c* and adhere the secondary label 210*c* to the individual container by means of adhesive 208. Further, if the secondary distributor desires, he may remove secondary label 210*b* and place it in a conspicuous location. Indicia 212*b* may include, for example, warnings and instructions for patients. Moreover, label 200 may be constructed to include several secondary labels 210*b* so that a secondary label 210*b* may be applied to each individual patient container.

Label 200 as discussed above may be formed as follows. A six color Mark Andy 2200 flexographic printing press as discussed above may be used.

With reference to FIG. 7, self-adhesive stock web 232 is supplied from unwind stand 250. Self-adhesive stock web 232 preferably consists of a web of face stock releasably adhered to a release liner by means of a pressure sensitive adhesive coating. Self-adhesive stock web 232 may be, for example, high gloss paper with S246 adhesive available from Fasson.

Simultaneous with the supply of base web 232, self-adhesive stock web 234 is supplied from unwind stand 256. Self-adhesive stock web 234 may be provided as a self-adhesive face stock having a release liner, the release liner 236 simultaneously being removed to rewind stand 260. Self-adhesive stock web 234 may be, for example, high gloss paper with S246 adhesive available from Fasson.

Base web 232 first passes through varnish printer station 252 at which point silicon varnish is applied to selected portions of base web 232. More particularly, the selected portions correspond to the portions of the upper surface of base layer 206 adjacent secondary labels 210*b* and 210*c*. Thereafter, base web 232 passes through UV curing unit 254 in order to cure the applied varnish coating.

Base web 232 and self-adhesive stock web 234 are married at nip rollers 262, thereby forming multi-layer composite web 240. Notably, where varnish has not been applied by varnish print station 252 (i.e., adjacent primary label 210*a*), the two webs are substantially permanently adhered. Where varnish has been applied (i.e., adjacent secondary labels 210*b* and 210*c*), the webs are releasable adhered.

Composite web 240 is drawn through one or more print stations 264,266 to apply indicia 212*a*, 212*b*, 212*c*. Though not shown, the upper surface of base web 232 may be printed on as well prior to the application of the varnish.

Thereafter, composite web 240 is passed through varnish print station 270 which applies an overprint varnish to protect the aforesaid indicias. Coated composite web 240 is then passed through UV curing unit 272 to cure the varnish.

Composite web 240 is diecut by cutter 275 down to release liner 202 to form labels 200 and down to the face stock of web 232 to form cut lines 213,215 and, thus, secondary labels 210*b*,210*c*. Alternatively, the cut lines forming the label and the secondary labels may be executed by separate diecutters. The resulting waste matrix 242 (the portions of web 240 outside base 206) is taken up on rewind stand 274. The remaining construction which consists of label 200 disposed on release liner 202 may then be rewound onto rewind stand 276. Alternatively, the remaining construction may be sheeted and stacked.

Figure 8:
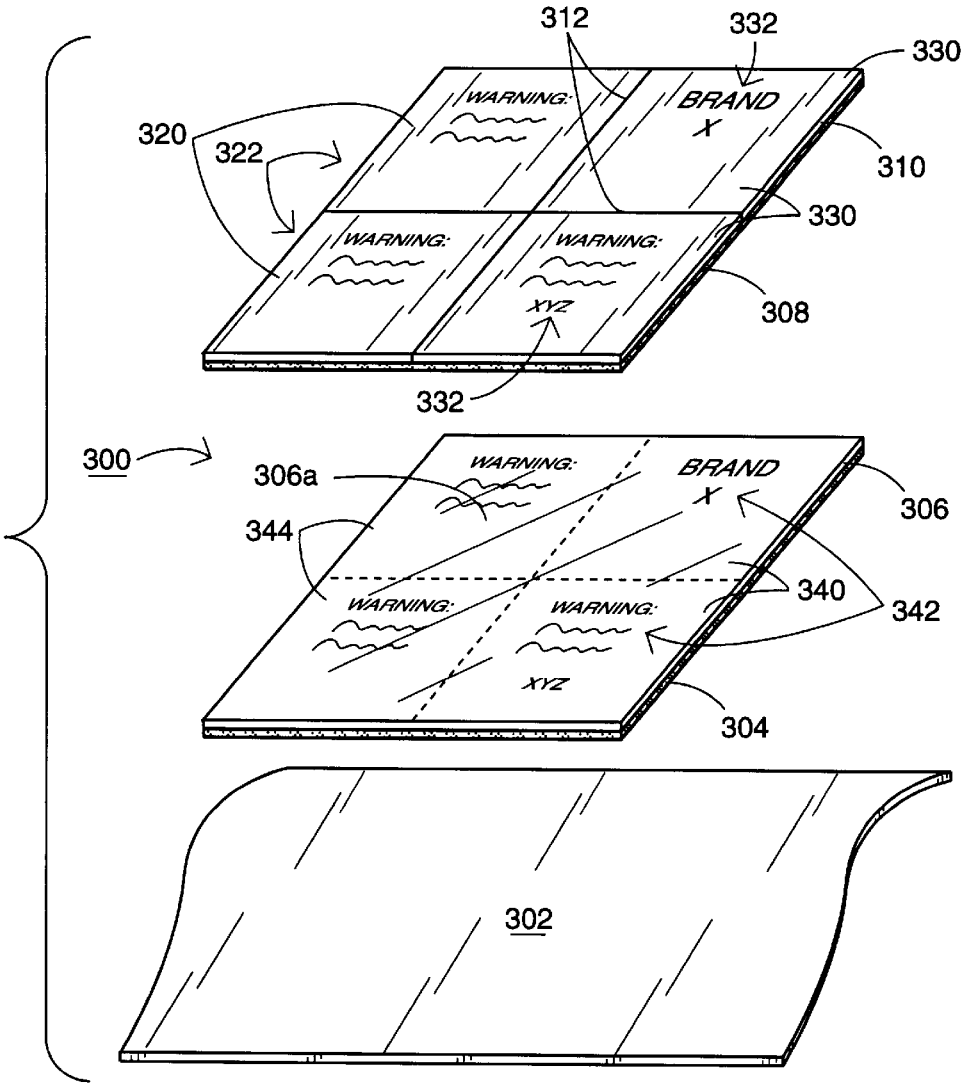
FIG. 8 is an exploded, perspective view of a label according to a third embodiment of the present invention.
Figure 9:
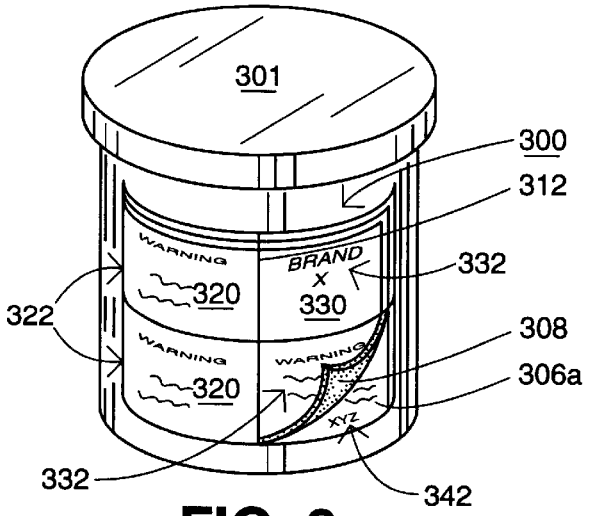
FIG. 9 is a perspective view of the label according to the third embodiment mounted on a container and wherein one of the secondary labels is partially removed.

With reference to FIGS. 8 and 9, a label according to a third embodiment of the present invention, generally denoted by the numeral 300, is shown therein. Label 300 is carried on release liner 302 and may be secured to a container 301 or the like.

Label 300 includes base layer 306 releasably adhered to release liner 302 by pressure sensitive adhesive 304. When label 300 is removed from release liner 302, adhesive 304 separates from the release liner and remains on the underside of base layer 306, providing a pressure sensitive label. For the purposes of explanation, the upper surface of base layer 306 is divided into four regions 340,344 as defined by dotted lines. Regions 340 are provided with primary indicia 342. The entire upper surface of base layer 306 is coated with varnish 306*a*.

Top layer 310 is releasably adhered to the upper surface of base layer 306 by pressure sensitive adhesive 308. Cut lines 312 define secondary labels 320, and tertiary labels 330. Secondary labels 320 are provided with secondary indicia 322. Tertiary labels 330 are provided with tertiary indicia 332. Tertiary indicia 332 is preferably identical to the primary indicia 342 of the underlying region 340.

In use, label 300 may be removed from release liner 302 by separating adhesive 304 from release liner 302. Label 300 is then adhered to container 301, for example, by means of pressure sensitive adhesive 304. When desired, one or both of secondary labels 320 may be removed from the respective region 344 of base layer 306, varnish coating 306*a* allowing pressure sensitive adhesive 308 to remain with the secondary label 320. Moreover, if one or both of tertiary labels 330 are removed, deliberately or inadvertently, indicia 342 of underlying regions 340 will be exposed, thereby serving the function of a primary label. Further, it will be appreciated that if permanent pressure sensitive adhesive as preferred is used, regions 340 of base layer 306 cannot be removed from container 301.

Label 300 may be formed according to the same method and using the same apparatus as label 200 as discussed above, except for the following. In the case of label 300, the step of printing on the upper surface of base layer 306 is not optional, but rather primary indicia 342 must be printed. Preferably, primary indicia 342 are printed on the upper surface of base layer 306 prior to the application of varnish 306*a*. Second, varnish 306*a* must be applied over the entire upper surface of base layer 306, or in any event, on at least all portions of the upper surface of base layer 306 which are to underlie top layer 310. This may be accomplished by flood coating, for example.

Figure 10:
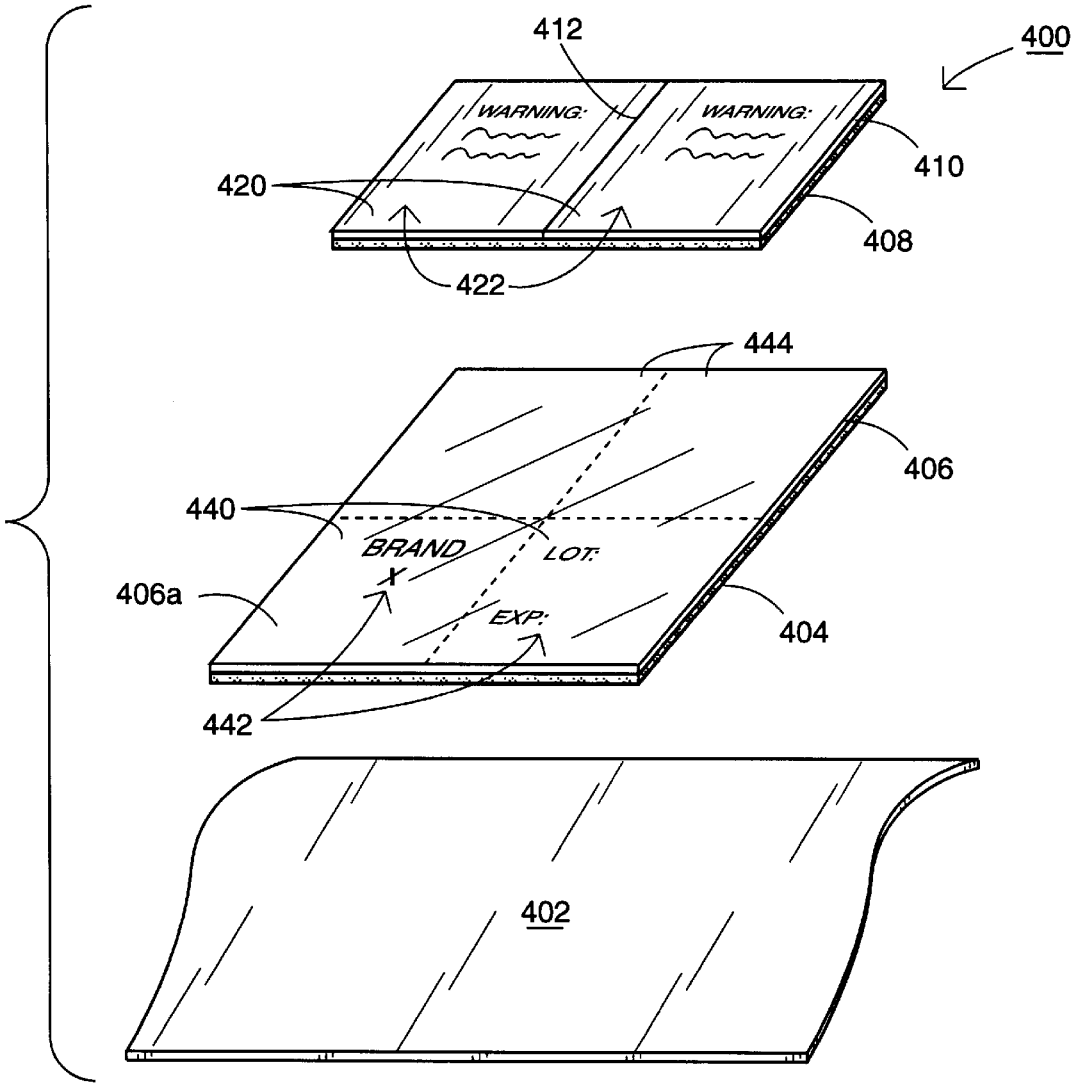
FIG. 10 is an exploded, perspective view of a label according to a fourth embodiment of the present invention.
Figure 11:
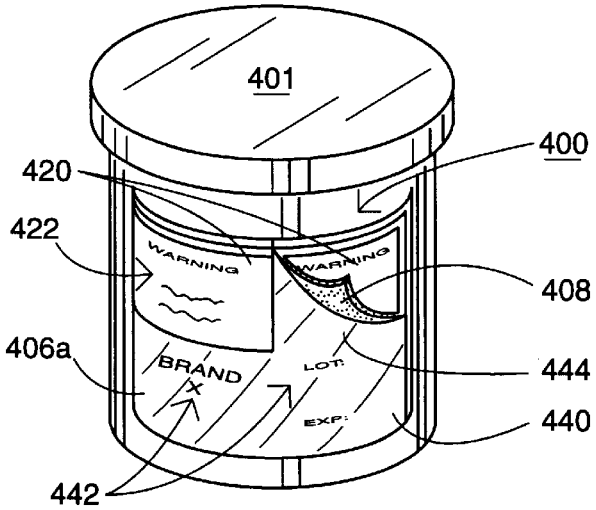
FIG. 11 is a perspective view of the label according to the fourth embodiment mounted on a container and wherein one of the secondary labels is partially removed.

With reference to FIGS. 10 and 11, a label according to a fourth embodiment of the present invention, generally denoted by the numeral 400, is shown therein. Label 400 is carried on release liner 402 and may be secured to a container 401, for example, or the like.

Label 400 includes base layer 406 releasably adhered to release liner 402 by pressure sensitive adhesive 404. When label 400 is removed from release liner 402, adhesive 404 separates from the release liner and remains on the underside of base layer 406, providing a pressure sensitive label. For the sake of explanation, base layer 406 is divided into regions 440,444 defined by the dotted lines. Primary label regions 440 are provided with primary indicia 442. The entire upper surface of base layer 406 is coated with varnish 406*a*.

Top layer 410 is adhered to the upper surface of base layer 406 by pressure sensitive adhesive 408. Cut line 412 defines secondary labels 420. Secondary labels 420 each include adhesive 408 on their underside and are provided with indicia 422 on their upper surface. When label 400 is constructed as shown in FIG. 11, secondary labels 420 overlie regions 444 of base layer 406. Secondary labels 422 are releasably adhered to the upper surface of base layer 406 by the interface of adhesive 408 and varnish 406*a*.

Label 400 may be used substantially in the manner as described above with respect to labels 100, 200, and 300. Label 400 may be removed from release liner 402 and adhered to a container 401, for example, by means of adhesive 404. When desired, one or both of secondary labels 420 may be peeled away from the varnish coated upper surface of base layer 406 and adhered to a second container by means of adhesive 408. Notably, primary label regions 440 which form a part of base layer 404 remain with container 401.

Label 400 as discussed above may be formed substantially according to the process and using the apparatus as discussed above with respect to label 200, except for the following. The upper self-adhesive stock web (i.e., corresponding to stock web 234) is provided in a width less than that of the lower self-adhesive stock web (i.e., corresponding to self-adhesive stock web 232). Alternatively, the upper self-adhesive stock web may be slit prior to marrying it with the lower self-adhesive stock web, the portion of the web corresponding to secondary labels 420 being married to the lower web and the remainder being removed by a rewinding station. Second, varnish 406*a* must be applied over the entire upper surface of base layer 406, or in any event, on at least all portions of the upper surface of base layer 406 which are to underlie top layer 410. This may be accomplished by flood coating, for example.

Figure 12:
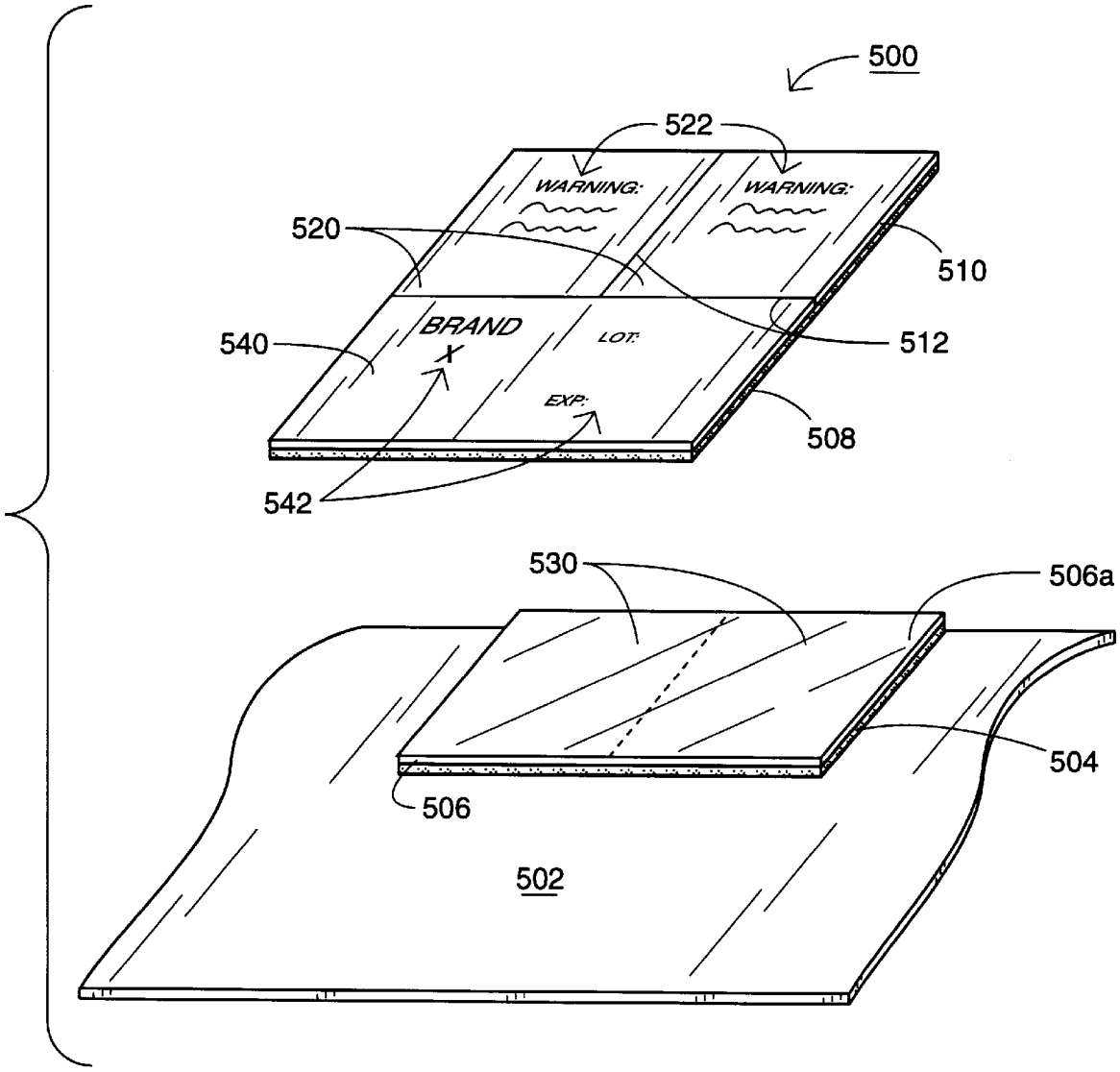
FIG. 12 is an exploded, perspective view of a label according to a fifth embodiment of the present invention.
Figure 13:
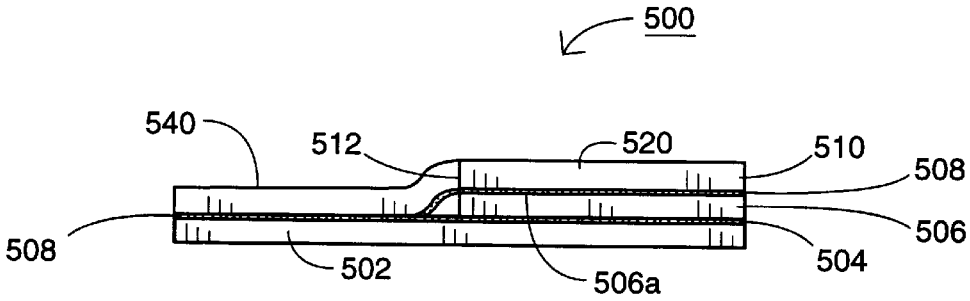
FIG. 13 is a front elevational view of the label according to the fifth embodiment on a release liner.

With reference to FIGS. 12 and 13, a label according to a fifth embodiment of the present invention, generally denoted by the numeral 500, is shown therein. Label 500 is carried on release liner 502 and may be secured to a container or the like.

Label 500 includes base layer 506 releasably adhered to release liner 502 by pressure sensitive adhesive 504. Notably, the width of base layer 506 is less than the width of release liner 502. When label 500 is removed from release liner 502, adhesive 504 (as well as a portion of adhesive layer 508, as discussed below) separates from the release liner and remains on the underside of base layer 506, providing a pressure sensitive label. To aid in explanation, base layer 506 is divided into regions 530 defined by the dotted line. The entire upper surface of base layer 506 is coated with varnish 506*a*.

Top layer 510 is coated on its underside with pressure sensitive adhesive 508. Secondary labels 520 and primary label 540 are defined by cut lines 512. Secondary labels 520 are provided with secondary indicia 522. Primary label 540 is provided with primary indicia 542. As best seen in FIG. 13, the portion of pressure sensitive adhesive 508 underlying primary label 540 is releasably adhered to release liner 502. The portion of pressure sensitive adhesive 508 underlying secondary labels 520 is releasably adhered to the upper surface of base layer 506, varnish 506*a* providing the releasability.

In use, label 500 is removed from release liner 502 and applied to a container or the like. Adhesive 504 and the portion of adhesive 508 underlying primary label 540 will adhere to the container, preferably permanently. Secondary labels 520 may be peeled away from the varnish coated upper surface of base layer 506 as desired and applied to other containers, for example.

Label 500 may be formed according to the same method and using the same apparatus as discussed with regard to label 200 above, except for the following. Prior to marrying the upper and lower webs, the base web is die cut lengthwise and the unwanted portion is removed, leaving the portion which ultimately becomes base layer 506 on release liner 502. The top web is then laminated onto the lower web such that secondary labels 520 overlie regions 530. Second, varnish 506*a* must be applied over the entire upper surface of base layer 506, or in any event, on at least all portions of the upper surface of base layer 506 which are to underlie top layer 510. This may be accomplished by flood coating, for example.

Figure 14:
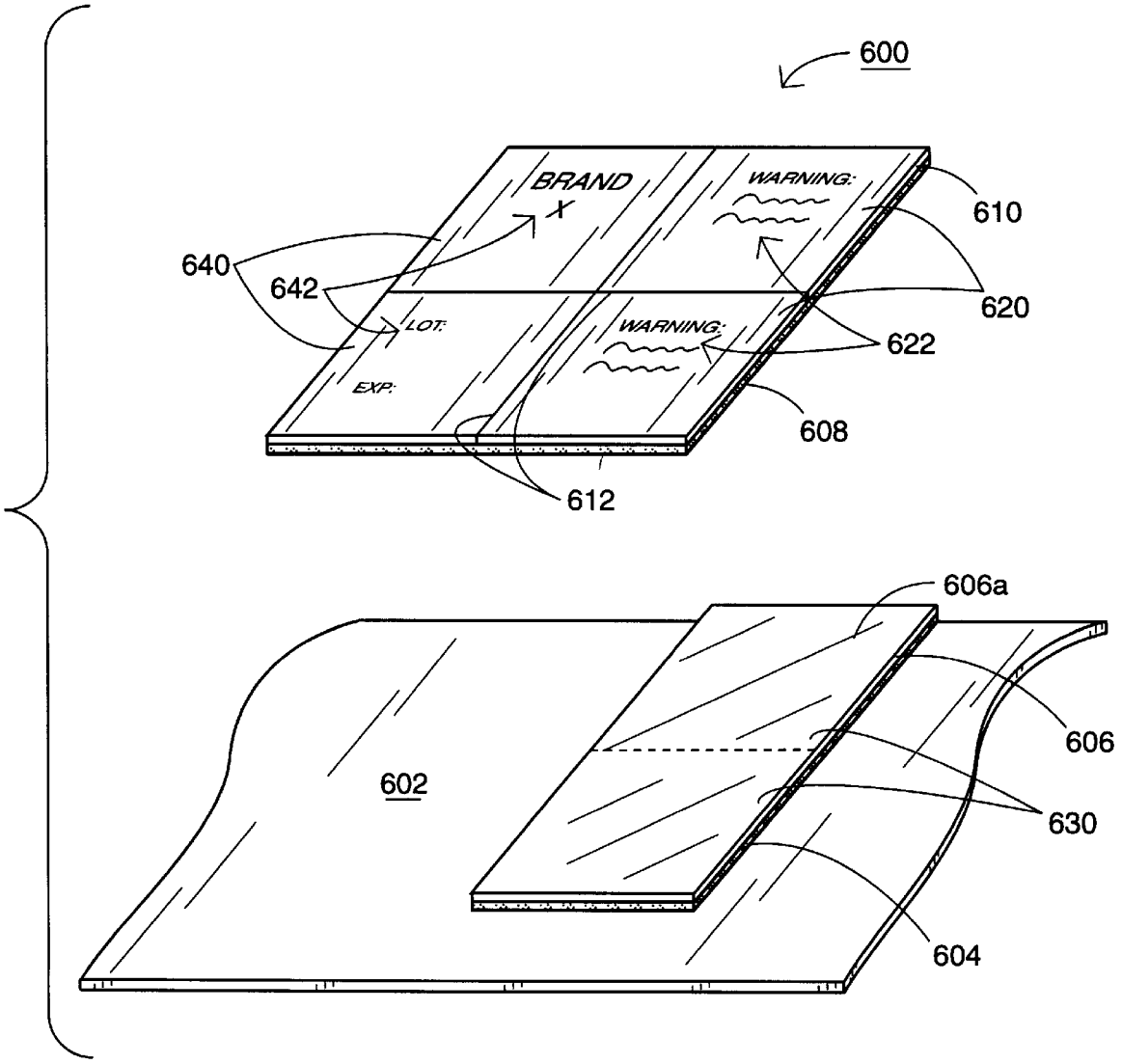
FIG. 14 is an exploded, perspective view of a label according to a sixth embodiment of the present invention.
Figure 15:
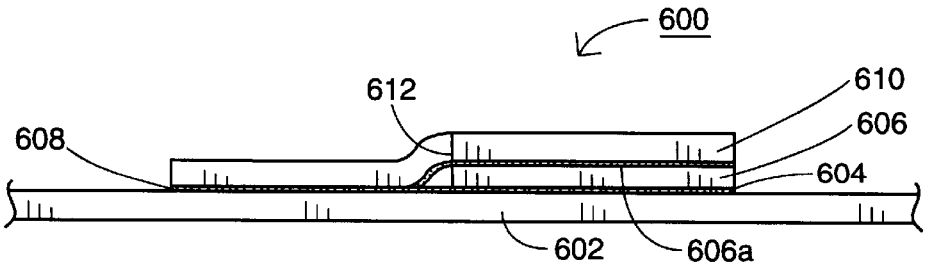
FIG. 15 is a side elevational view of the label according to the sixth embodiment on a release liner.

With reference to FIGS. 14 and 15, a label according to a sixth embodiment of the present invention, generally denoted by the numeral 600, is shown therein. Label 600 is carried on release liner 602 and may be secured to a container or the like.

Label 600 is substantially the same as label 500. Elements 604, 606, 606*a*, 608, 610, 612, 620, 622, 630, 640, and 642 correspond to elements 504, 506, 506*a*, 508, 510, 512, 520, 522, 530, 540, and 542, respectively. Label 600 differs from label 500 in that regions 630, secondary label 620, and primary label 640 are reoriented with respect to the length of release liner 602. Accordingly, a side view of label 600 as shown in FIG. 15 is identical to an end view of label 500 as shown in FIG. 13.

Label 600 may likewise be formed using substantially the same method and apparatus as described above with regard to label 200, except as follows. As in the formation of label 500, prior to marrying the upper and lower webs, the lower web is die cut to form base layers 606 in the indicated shape. Preferably, the cut lines transverse to the web do not extend as far as at least one side edge of the web so that a lengthwise strip of face stock continues along the edge of the web and adjacent base layer 606 so that the waste matrix is continuous. This aids in the removal of the waste matrix. After the waste matrix has been removed, the top web is laminated onto the lower web such that secondary labels 620 are mated with regions 630. Second, varnish 606*a* must be applied over the entire upper surface of base layer 606, or in any event, on at least all portions of the upper surface of base layer 606 which are to underlie top layer 610. This may be accomplished by flood coating, for example.

Figure 16:
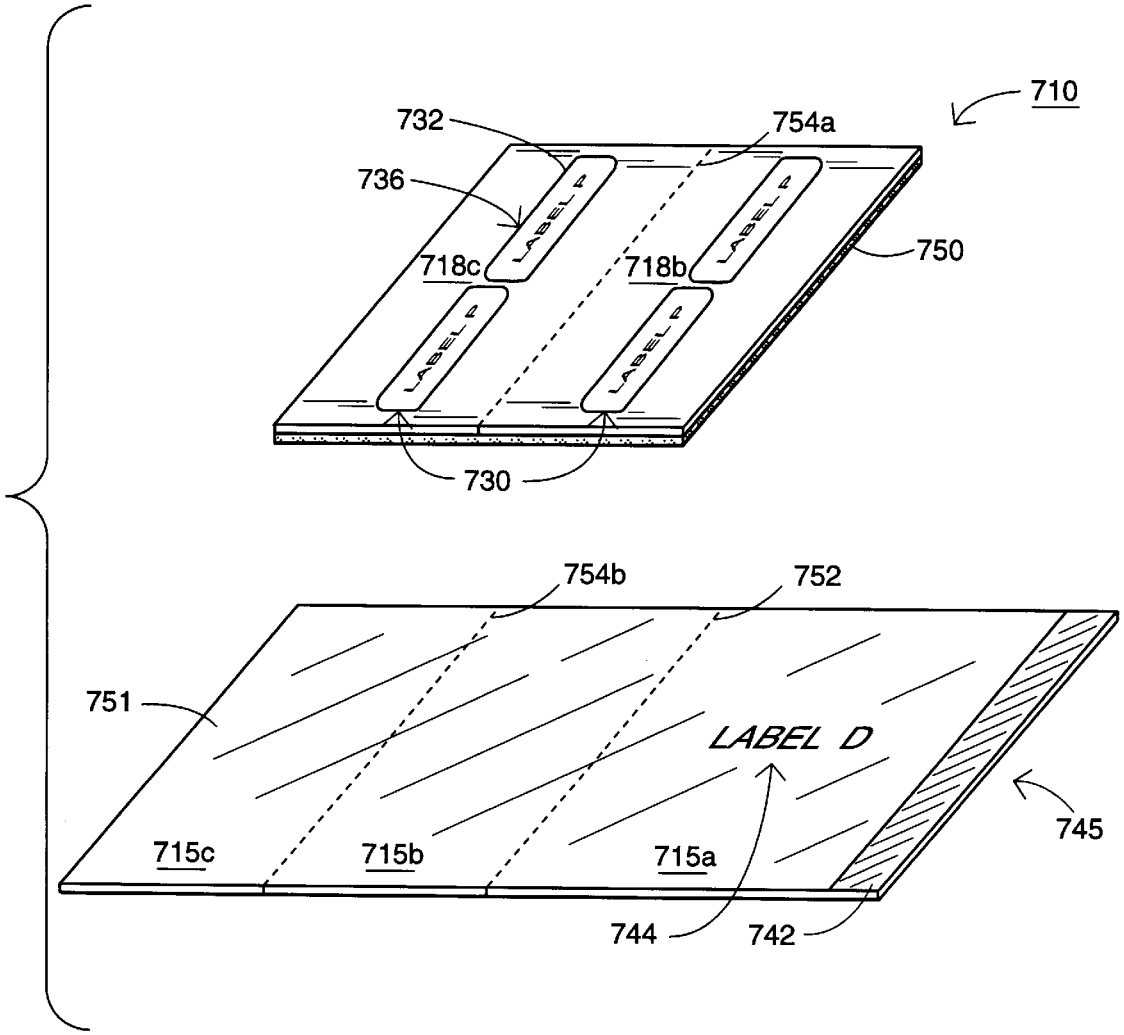
FIG. 16 is an exploded, perspective view of a leaflet according to a seventh embodiment of the present invention.
Figure 17:
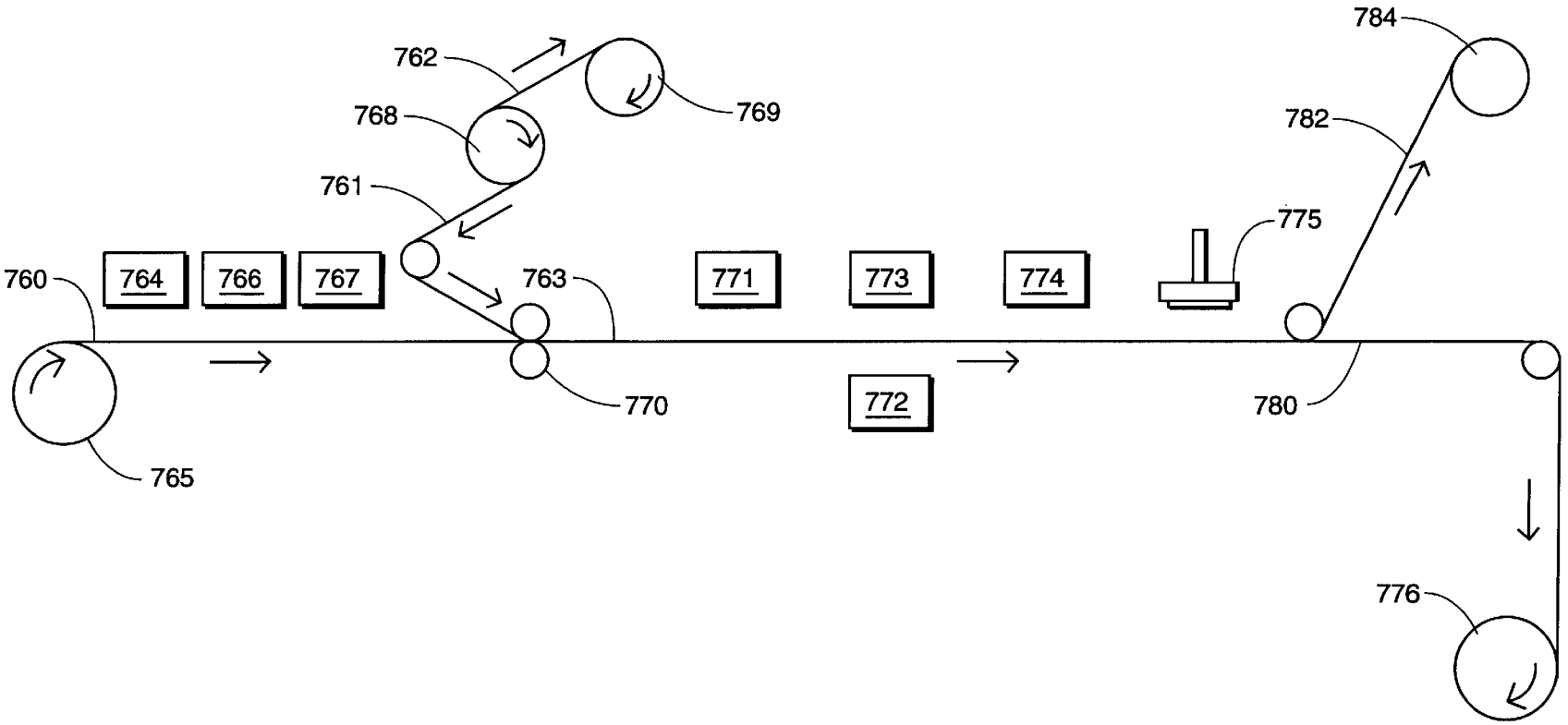
FIG. 17 is a schematic diagram showing an apparatus for forming leaflets according to the seventh embodiment.

With reference to FIGS. 16 and 17, a leaflet, generally denoted by the numeral 710, may be incorporated into a label according to a seventh embodiment of the present invention. As will be appreciated from the following discussion, leaflet 710 is functionally substantially the same as leaflet 110 as described above. Accordingly, leaflet 710 may be covered by a laminate cover corresponding to cover 120, disposed on an adhesive patch corresponding to adhesive patch 114, which may in turn be disposed on a release liner corresponding to release liner 112 or on a container.

Turning to leaflet 710 in greater detail, the leaflet includes first layers 715*a*, 715*b*, and 715*c* corresponding to first layers 115*a*, 115*b*, and 115*c* of the first embodiment, respectively. Leaflet 710 further includes second layers 718*b* and 718*c* corresponding to second layers 118*b* and 118*c*, respectively, of the first embodiment. Notably, there is no portion of leaflet 710 which corresponds to second layer 118*a* of the first embodiment. Thus, first layer 715*a* itself serves as a primary label or panel whereas primary label 110*a* of the first embodiment is a two-ply construction.

Elements 730, 732, 736, 742, 744, 745, 750, and 752 correspond to elements 130, 132, 136, 142, 144, 145, and 152, respectively, of the first embodiment. Adhesive 750 corresponds to adhesives 150*b* and 150*c*. Tear lines 754*a* and 754*b* correspond to tear line 154 of leaflet 110.

Whereas in the case of leaflet 110 only the upper surfaces of first layers 115*b* and 115*c* are coated with varnish, the upper surfaces of first layers 715*a*, 715*b*, and 715*c* are each completely coated with varnish. Also, primary indicia 144 is printed on the upper surface of first layer 715*a* rather than on a superimposed second layer.

Leaflets 710 as described above may be formed as follows. A six color Mark Andy 2200 flexographic printing press may be used to form leaflet 710, however, any suitable apparatus may be used. Other suitable apparatus include letter presses and offset presses.

With reference to FIG. 17, base web 760 is supplied from unwind stand 765. Simultaneous with the supply of base web 760, self-adhesive stock web 761 is supplied from unwind stand 768. Base web 760 ultimately forms first layers 715*a*, 715*b*, 715*c* of the resulting leaflets 710. Self-adhesive stock web 761, with release liner 762 removed, ultimately forms second layers 718*b*,718*c* of leaflets 710.

Base web 760 is preferably a simple base stock formed from paper and having no adhesive layer or release liner. Base web 760 first passes through print station 764 which prints primary indicia 744 on the upper surface of the portion of base web 760 which ultimately becomes first layer 715*a* of the resultant leaflet. Thereafter, base web 760 passes through varnish printer station 766 at which point varnish (including varnish strip 742) is applied to the entire upper surface of the base web. Thereafter, base web 760 passes through UV curing unit 767 in order to cure the applied varnish coating.

Self-adhesive stock web 761 may be provided as a self-adhesive face stock having a release liner, the release liner 762 simultaneously being removed to rewind stand 769. Self-adhesive stock web 761 may be, for example, high gloss paper with S246 adhesive available from Fasson.

Base web 760 and self-adhesive stock web 761 are married at nip rollers 770, thereby forming multilayer composite web 763. Notably, webs 760 and 761 are releasably adhered throughout the length of composite web 763.

Composite web 763 is drawn through one or more print stations 771 to apply graphics and indicia including secondary indicia 736. Composite web 763 may also pass through any number of print stations 772 to print graphics and other indicia on the lower surface of the base web (i.e., to apply indicia corresponding to indicia 117*b*,117*c* of leaflet 110).

Composite web 763 then passes through varnish print station 773 which applies an overprint varnish to protect the indicias applied at print stations 771,772. Coated composite web 763 then passes through UV curing unit 774 to cure the varnish.

Composite web 763 is then die cut by die cut station 775 down to base web 760 to form cut lines 732 which define secondary labels 730. Die cut station 775 also forms a cut line through upper web 761 down to base web 760. This cut line defines the edge of second layer 718*b* adjacent first layer 715*a*.

The portion of upper web 761 overlying the portion of base web 760 corresponding to first layer 715*a* (i.e., the portion of upper web 761 corresponding to first layer 118*a* of leaflet 110) is then removed by rewind station 784. Preferably, the die cut station also makes cut lines parallel to the length of the web and the cut lines transverse to the web do not extend as far as at least one side edge of the web. As a result, a lengthwise strip of face stock continues along the edge of the web so that the waste matrix 782 is continuous.

The resulting construction 780 may thereafter be "sheeted" into individual strips and stacked or, alternatively, rewound onto rewind stand 776 and later cut into individual strips. Alternatively, web construction 780 may be cut and folded on a roll folder.

Labels may be formed using leaflets 710 by the method described for forming labels 100 from leaflets 110. Moreover, leaflet 710 and labels therefrom will have substantially the same characteristics and may be used in substantially the same manner as leaflets 110 and labels 100.

Further, leaflets 710 and labels formed therefrom may include any number of unadhered panels.

It will be appreciated that the provision of UV curable silicon varnish or the like as described with respect to labels 100 and 200 provides certain advantages. There is a reduced or eliminated tendency for adhesive to migrate into the areas where varnish has been applied, unlike the case where adhesive deadener is used. Further, graphics underlying the varnish, if any, are protected so that they are not mutilated or obliterated by the removal of the overlying secondary label portions.

A primary advantage of each of the disclosed embodiments attributable to the provision of a varnish coating is that virtually any combination of base web and pressure sensitive adhesive (i.e., on the underside of the secondary label or labels) may be used. The securement between the secondary label and the base layer is a function of the adhesion between the varnish and the adhesive. The degree of adhesion may be controlled by the selection of the varnish material. As a result, if desired, the secondary label may be provided with an aggressive "high-tack" or permanent adhesive without compromising the convenient separability of the secondary label from the base layer.

It will be appreciated that each of the labels described above, as well as leaflet 110 address the problem of mismatching primary and secondary labels. Because the leaflet 110 and labels are formed as a unitary construction and both the primary and secondary portions are printed while the construction is in a unitary configuration, there is no danger that the primary and secondary portions will be improperly mated.

In each of the third, fourth, fifth, sixth, and seventh embodiments if the entire upper surface of the respective base layer is flood coated with varnish as preferred, the efficiency and quality of label construction is greatly enhanced. This is because the need to properly register the printed varnish is substantially reduced or eliminated.

While a preferred embodiment of the present invention has been described, it will be appreciated by those of skill in the art that certain modifications may be made without departing from the scope of the present invention. All such modifications are intended to come within the scope of claims which follow.

What is claimed is:

1. A label product made up of first and second types of labels formed integrally together in which the first type includes primary information to be used on a first type of package and the second type includes secondary information to be used on a second type of package, said label product comprising:

a) a permanent portion having an upper surface and a lower surface and said lower surface being coated with a first, permanent adhesive, said first adhesive operative to substantially permanently secure said permanent portion to the first package such that said permanent portion cannot be removed from the first package without damaging either of said permanent portion and the first package;

b) a primary label integrally formed with and permanently secured to said permanent portion such that said primary label cannot be removed from the permanent portion without damaging either of said primary label and said permanent portion so that said primary label is substantially permanently secured to the first package when said permanent portion is substantially permanently secured to the first package, said primary label having an upper surface and a lower surface, said upper surface having a primary indicia thereon, said primary indicia representing the primary information concerning said first type of package;

c) at least one temporary portion integrally formed with but removably secured to said permanent portion such that said temporary portion may be selectively removed from the first package; and d) a secondary label forming at least a part of said temporary portion, said secondary label having an upper surface and a lower surface, said upper surface having a secondary indicia thereon and said lower surface being coated with a second adhesive, said secondary indicia representing the secondary information concerning said second type of package, said label product including a varnish coating underlying said secondary label, said secondary label adhesively and releasably adhered to said label product by said varnish coating and said second adhesive such that said secondary label may be selectively removed from said label product and applied to one of said second types of package.

2. The label product of claim 1 comprising a plurality of said secondary labels.

3. The label product of claim 1 including:

a) a base layer having a lower surface and an upper surface, said first adhesive disposed on said lower surface of said base layer;

b) a top layer overlying said base layer and having a lower surface and an upper surface, said primary label and said secondary label each forming a part of said top layer, said second adhesive disposed on said lower surface of said top layer; and c) wherein said varnish coating covers a portion of said upper surface of said base layer and a portion of said upper surface of said base layer is not covered by said varnish coating, said covered portion disposed beneath said secondary label and said uncovered portion disposed beneath said primary label so that said secondary label may be removed from said base layer and said primary label is permanently secured to said base layer.

4. The label product of claim 3 comprising a plurality of said secondary labels.

5. The label product of claim 3 wherein said second adhesive is operative to permanently secure said secondary label to the second types of package.

6. The label product of claim 1 wherein:

a) said permanent portion includes a first panel having an upper surface and a lower surface, said primary indicia disposed on said upper surface of said first panel and said first adhesive disposed on said lower surface of said first panel;

b) said temporary portion includes a second panel joined to an edge of said first panel by a fold; and c) wherein said secondary label is releasably adhered to said second panel by said second adhesive.

7. The label product of claim 6 comprising a plurality of said secondary labels.

8. The label product of claim 6 wherein said secondary label is adhered to an interior surface of said second panel, said varnish coating disposed on said interior surface adjacent said second adhesive.

9. The label product of claim 8 further including a laminate cover adhered to an exterior surface of said second panel and including a marginal portion extending beyond an edge of said second panel.

10. The label product of claim 9 wherein said first panel includes an edge flap extending beyond an adjacent edge of said second panel and wherein said marginal portion is releasably and resealably adhered to said edge flap by a laminate adhesive.

11. The label product of claim 9 wherein said second panel is detachably joined to said first panel.

12. The label product of claim 1 including:

a) a base layer having a lower surface and an upper surface, said first adhesive disposed on said lower surface and said varnish coating disposed on said upper surface;

b) a top layer overlying a portion of said upper surface of said base layer, said top layer having a lower surface and an upper surface, said secondary label forming a part of said top layer, said secondary indicia disposed on said upper surface of said top layer and said second adhesive disposed on said lower surface of said top layer; and c) wherein the entirety of said portion of said upper surface of said base layer is covered by said varnish coating, whereby the entirety of said top layer is releasably adhered to said portion by said second adhesive and said varnish coating.

13. The label product of claim 12 comprising a plurality of said secondary labels.

14. The label product of claim 12 wherein the entirety of said upper surface of said base layer is covered by said varnish coating.

15. The label product of claim 12 further including a tertiary label forming a part of said top layer and overlying a second portion of said upper surface of said base layer, said tertiary label having an upper surface, a lower surface, and tertiary indicia disposed on said upper surface of said tertiary label, said second adhesive disposed on said lower surface of said tertiary label, wherein said primary indicia is disposed on said upper surface of said base layer and said tertiary label overlies said primary indicia.

16. The label product of claim 15 comprising a plurality of said secondary labels.

17. The label product of claim 15 wherein said tertiary indicia is substantially identical to said primary indicia.

18. The label product of claim 15 wherein the entirety of said upper surface of said base layer is covered by said varnish coating.

19. The label product of claim 12 wherein said upper surface of said base layer includes an exposed portion which is not covered by said top layer, said primary indicia being disposed on said exposed portion.

20. The label product of claim 19 comprising a plurality of said secondary labels.

21. The label product of claim 19 wherein the entirety of said upper surface of said base layer is covered by said varnish coating.

22. The label product of claim 12 wherein said primary label forms a part of said top layer, and wherein said primary label extends beyond and does not overlie said base layer.

23. The label product of claim 22 comprising a plurality of said secondary labels.

24. The label product of claim 22 wherein the entirety of said upper surface of said base layer is covered by said varnish coating.

25. The label product of claim 12 wherein said base layer comprises first and second panels joined to one another at a fold, each of said panels having an upper surface and a lower surface, wherein said first adhesive is disposed on said lower surface of said first panel but not on said lower surface of said second panel and said primary indicia is disposed on said upper surface of said first panel, and wherein said top layer overlies said upper surface of said second panel.

26. The label product of claim 25 comprising a plurality of said secondary labels.

27. The label product of claim 25 wherein said first and second panels are detachably joined at said fold by a tear line.

28. The label product of claim 25 wherein the entireties of said upper surfaces of said first and second panels are covered with said varnish coating.

29. The label product of claim 25 wherein said top layer is substantially transparent.

30. The label product of claim 1 wherein said second adhesive is operative to permanently secure said secondary label to the second types of package.

* * * * *